US005964633A

United States Patent [19]

Brown, II et al.

[11] Patent Number: 5,964,633

[45] Date of Patent: Oct. 12, 1999

[54] METHOD OF HEAT SHRINK ASSEMBLY OF TRAVELING WAVE TUBE

[75] Inventors: Richard A. Brown, II, Long Beach; Edward A. Adler, Los Angeles, both of Calif.

[73] Assignee: Hughes Electronics Corporation, Los Angeles, Calif.

[21] Appl. No.: 08/990,357

[22] Filed: Dec. 15, 1997

[51] Int. Cl.[6] ..... H01J 9/18

[52] U.S. Cl. ..... 445/34; 445/33

[58] Field of Search ..... 445/33, 34; 29/447; 315/3, 5

[56] References Cited

U.S. PATENT DOCUMENTS

| | | | |
|---|---|---|---|
| 2,740,913 | 4/1956 | Majkrzak | 445/33 |
| 3,394,453 | 7/1968 | Wallace et al. | 29/447 |
| 3,540,119 | 11/1970 | Manoly | 29/447 |
| 4,840,595 | 6/1989 | Bibracher et al. . | |

FOREIGN PATENT DOCUMENTS 0802 557 10/1997 European Pat. Off. .

OTHER PUBLICATIONS

Curren A. N. et al., "The Cassini Mission KA–Band TWT", 1995 IEEE International Conference On Systems, Man and Cybernetics, Vancouver, Oct. 22–25, 1995, pp. 783–786, XP000585603, Institude of Electrical and Electronics Engineers.

Patent Abstracts of Japan, vol. 097, No. 012, Dec. 25, 1997 JP 09 213226 A. (NEC Corp.), Aug. 15, 1997.

*Primary Examiner*—Kenneth J. Ramsey

*Attorney, Agent, or Firm*—Terje Gudmestad; Georgann S. Grunebach; Michael W. Sales

[57] ABSTRACT

A traveling wave tube having an electron gun and a collector assembly is provided. The assemblies include a sleeve placed around an isolator. The sleeve is either heat shrunk or heat deformed around the isolator. Heat shrinking is performed when the sleeve radius is initially larger than the isolator radius. During heat shrinking, the sleeve is heated to cause the sleeve radius to increase and be larger than the isolator radius. The sleeve is then placed around the isolator and cooled causing the sleeve to contract upon the isolator. Heat deformation is performed when the sleeve radius is initially smaller than the isolator radius. During heat deformation, the isolator is inserted into the sleeve. The isolator and the sleeve are then heated so that the sleeve expands to a constrained amount of expansion and then deforms. The sleeve and the isolator are then cooled causing the sleeve to contract upon the isolator.

11 Claims, 5 Drawing Sheets

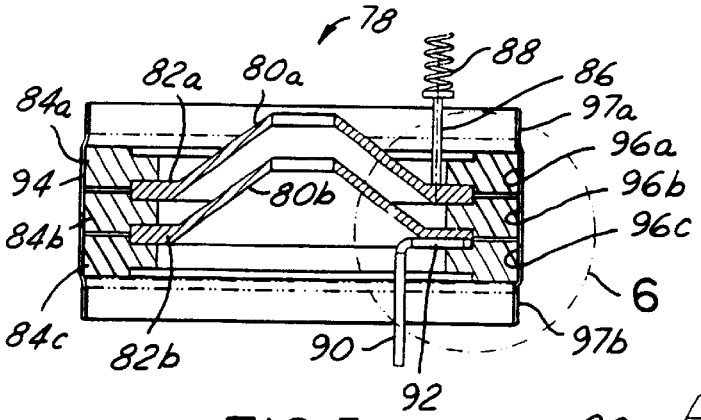
FIG.5
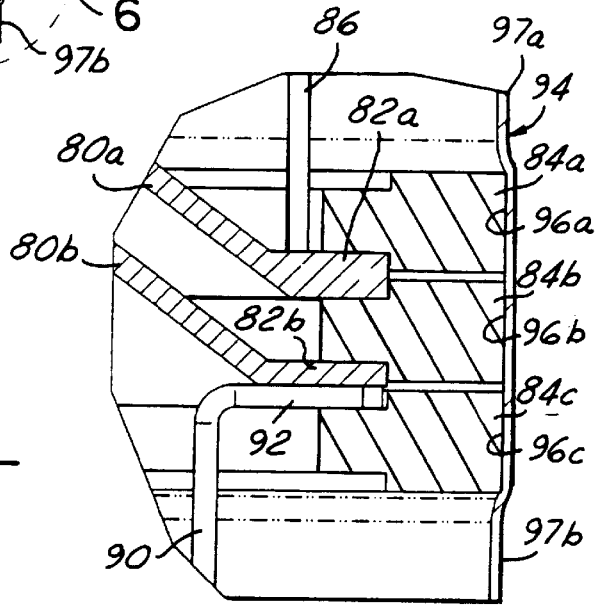
FIG.6
FIG.7
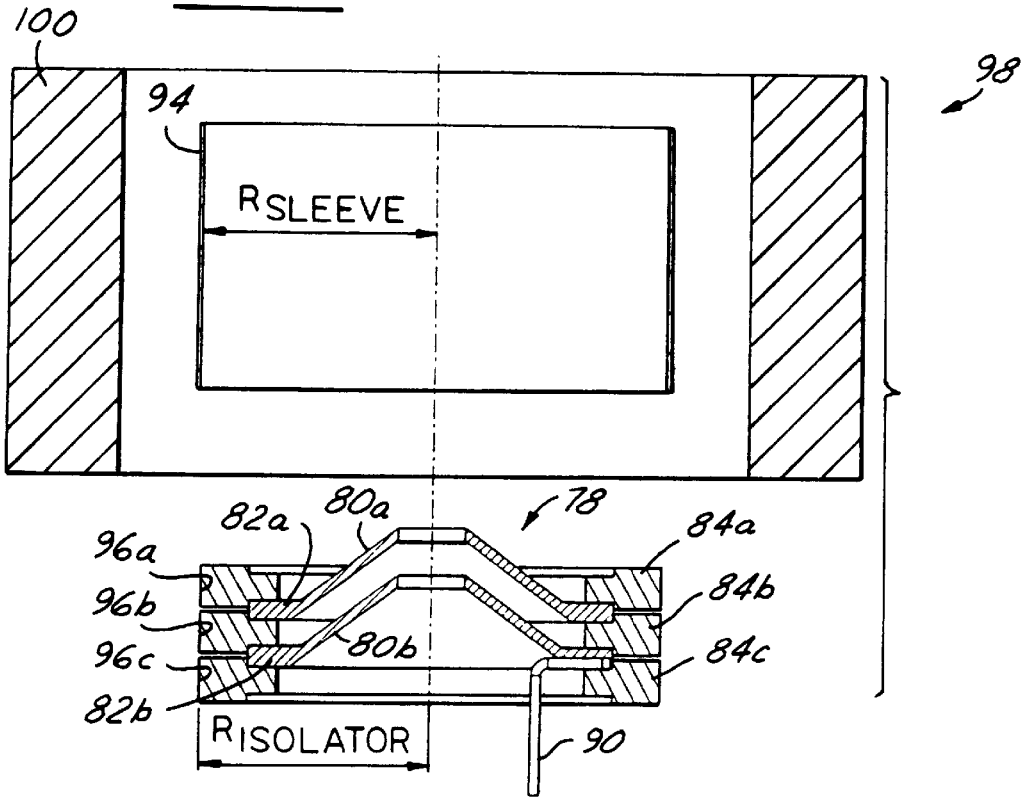

METHOD OF HEAT SHRINK ASSEMBLY OF TRAVELING WAVE TUBE

TECHNICAL FIELD

The present invention relates generally to traveling wave tubes and, more particularly, to heat shrunk/deformed sleeves for electron gun and collector assemblies.

BACKGROUND ART

An exemplary traveling wave tube (TWT) 20 is illustrated in FIG. 1. The elements of TWT 20 are generally coaxially arranged along a TWT axis 22. They include an electron gun assembly 24, a slow wave structure (SWS) 26, a beam focusing arrangement 28 which surrounds SWS 26, a microwave signal input port 30 and a microwave signal output port 32 which are coupled to opposite ends of SWS 26, and a collector assembly 34. A housing 36 is typically provided to protect the TWT elements.

In operation, electron gun assembly 24 launches a beam of electrons into SWS 26. Beam focusing arrangement 28 guides the beam of electrons. A microwave input signal 38 is inserted at input port 30 and moves along SWS 26 to output port 32. SWS 26 causes the phase velocity (i.e., the axial velocity of the signal's phase front) of the microwave signal to approximate the velocity of the electron beam.

As a result, the beam's electrons are velocity modulated into bunches which overtake and interact with the slower microwave signal. In this process, kinetic energy is transferred from the electrons to the microwave signal; the signal is amplified and is coupled from output port 32 as an amplified microwave output signal 40. After their passage through SWS 26, the beam's electrons are collected in collector assembly 34.

Electron gun assembly 24, SWS 26, and collector assembly 34 are again shown in the TWT schematic of FIG. 2. Electron gun assembly 24 has a cathode 42 and an anode 44. Collector assembly 34 has a first collector stage 46, a second collector stage 48, and a third collector stage 50.

SWS 26 and body 52 of TWT 20 are at ground potential. Cathode 42 is biased negatively by a voltage $V_{cath}$ from a cathode power supply 54. An anode power supply 56 is referenced to cathode 42 and applies a positive voltage to anode 44. This positive voltage establishes an acceleration region 58 between cathode 42 and anode 44. Electrons are emitted by cathode 42 and accelerated across acceleration region 58 to form electron beam 60.

As described above with reference to FIG. 1, electron beam 60 travels through SWS 26 and exchanges energy with a microwave signal which travels along the SWS from input port 30 to output port 32. Only a portion of the kinetic energy of electron beam 60 is transferred in this energy exchange. Most of the kinetic energy remains in electron beam 60 as it enters collector assembly 34. A significant part of this kinetic energy can be recovered by decelerating the electrons before they are collected by collector assembly 34.

Electron deceleration is achieved by application of negative voltages to collector assembly 34. The potential of collector assembly 34 is "depressed" from that of TWT body 52 (i.e., made negative relative to the TWT body). The kinetic energy recovery is further enhanced by using a multistage collector, e.g., collector assembly 34, in which each successive stage is further depressed from the body potential of $V_B$. For example, if first collector stage 46 has a potential of $V_1$, second collector stage 48 has a potential of $V_2$ and third collector stage 50 has a potential of $V_3$, these potentials are typically related by the equation $V_B=0>V_1>V_2>V_3$, as indicated in FIG. 2. A collector power supply 62 applies voltages $V_1$, $V_2$, and $V_3$ to depress the respective collector stages.

Collector assembly 34 includes a ceramic isolator or insulator to electrically isolate the collector stages from TWT body 52. The collector stages must be isolated from one another because they have different voltage potentials. Accordingly, the collector stages are secured to the inner surface of the isolator. The isolator also assists in dispersing the heat created by the electrons striking the collector stages. The outer surface of the isolator is secured to a sleeve. The sleeve forms a vacuum envelope for collector assembly 34. The sleeve is typically fabricated of a metal or a metal/ceramic composite assembly.

Cathode 42 and anode 44 are also biased at a different voltages than TWT body 52. Therefore, a ceramic isolator or insulator is used as part of the mechanical structure of electron gun assembly 24 to electrically isolate cathode 42 and anode 44. The isolator also disperses heat created by cathode 42.

Electron gun assembly 24 operates within a vacuum envelope. To form the vacuum envelope, a sleeve is placed around the isolator, the cathode, and the anode. The sleeve is typically fabricated of a metal or a metal/ceramic composite assembly.

In typical TWTs, brazing and welding are used to connect the sleeves, the isolators, the collector stages, the anode, and the cathode of the electron gun and collector assemblies. In particular, the sleeves are brazed or welded to the outer surfaces of the isolators. The collector stages, the anode, and the cathode are brazed or welded to the inner surfaces of the sleeves. Furthermore, electrode lead connections may be brazed or welded to the collector stages, the anode, the cathode, and the isolators.

Copper, gold, or silver alloys are used for brazing or welding. A primary disadvantage with these methods is that they limit the types of materials that may be used for the cathode, anode, collector stages, lead connections, isolators, and sleeves. Furthermore, these components must be prepared extensively so that they have proper brazing and welding surfaces. For instance, it is often necessary to use a multiple brazing process with alloys, such as active braze alloys, having different melting points or material compatibilities.

These methods are disadvantageous because the vacuum pressure within the electron gun and collector assemblies or the electrical resistivity of the isolators may be adversely affected by the components being exposed to multiple processes. These methods are also disadvantageous because the different thermal expansion rates of the alloys may limit the operating temperature range of the TWT.

Thus, electron gun and collector assemblies fabricated without brazing or welding and in a minimum number of steps is needed.

SUMMARY OF THE INVENTION

Accordingly, it is an object of the present invention to provide a traveling wave tube having components of the electron gun and collector assemblies heat shrunk together.

It is another object of the present invention to provide a traveling wave tube having components of the electron gun and collector assemblies heat deformed together.

It is a further object of the present invention to provide a method for building electron gun and collector assemblies of a traveling wave tube using heat shrinking.

It is still another object of the present invention to provide a method for building electron gun and collector assemblies of a traveling wave tube using heat deformation.

It is still a further object of the present invention to provide electron gun and collector assemblies having an enlarged range of operating temperature as compared to brazed or welded electron gun and collector assemblies.

In carrying out the above objects and other objects, the present invention provides a traveling wave tube. The traveling wave tube includes an assembly having a sleeve and at least one isolator. The sleeve is heat shrunk around the at least one isolator.

Further, in carrying out the above objects and other objects, the present invention provides a method for fabricating an assembly of a traveling wave tube. The assembly has a sleeve and at least one isolator. The sleeve has a radius smaller than the radius of the at least one isolator. The method of fabrication includes heating the sleeve to cause the radius of the sleeve to increase and be larger than the radius of the at least one isolator. The heated sleeve is then placed around the at least one isolator. The heated sleeve is then cooled so that the heated sleeve contracts upon the isolator. The assembly can be either an electron gun assembly or a collector assembly.

Still further, in carrying out the above objects and other objects, the present invention provides another method for fabricating an assembly of a traveling wave tube. The assembly has a sleeve and at least one isolator. The sleeve has a radius larger than the radius of the at least one isolator. This method of fabrication includes placing the sleeve around the at least one isolator. The sleeve and the at least one isolator are then heated so that the sleeve expands to a constrained amount of expansion and then deforms. The sleeve and the at least one isolator are then cooled so that the heated sleeve contracts upon the at least one isolator. The assembly can be either an electron gun assembly or a collector assembly.

The advantages accruing to the present invention are numerous. Heat shrinking and heat deformation may be performed in a minimum number of steps. Thus, reducing cost and shortening cycle time as compared to brazing. Furthermore, the plating, metalizing, and multiple step brazing process may be eliminated so that the range of useable materials for the sleeve and the isolators may be increased. Additionally, having alloys present within the vacuum environment of the electron gun and collector assemblies is eliminated thus reducing gas generation, improving the electrical properties of the isolator, and expanding the range of operating temperature.

These and other features, aspects, and embodiments of the present invention will become better understood with regard to the following description, appended claims, and accompanying drawings.

BRIEF DESCRIPTION OF THE DRAWINGS

FIG. 5 is a cross-sectional view of a collector assembly according to the present invention;

FIG. 6 is a detailed view of the area within the dotted circle 6 shown in FIG. 5;

FIG. 7 illustrates a heat shrinking assembly setup in accordance with the present invention;

BEST MODES FOR CARRYING OUT THE INVENTION

Figure 1:
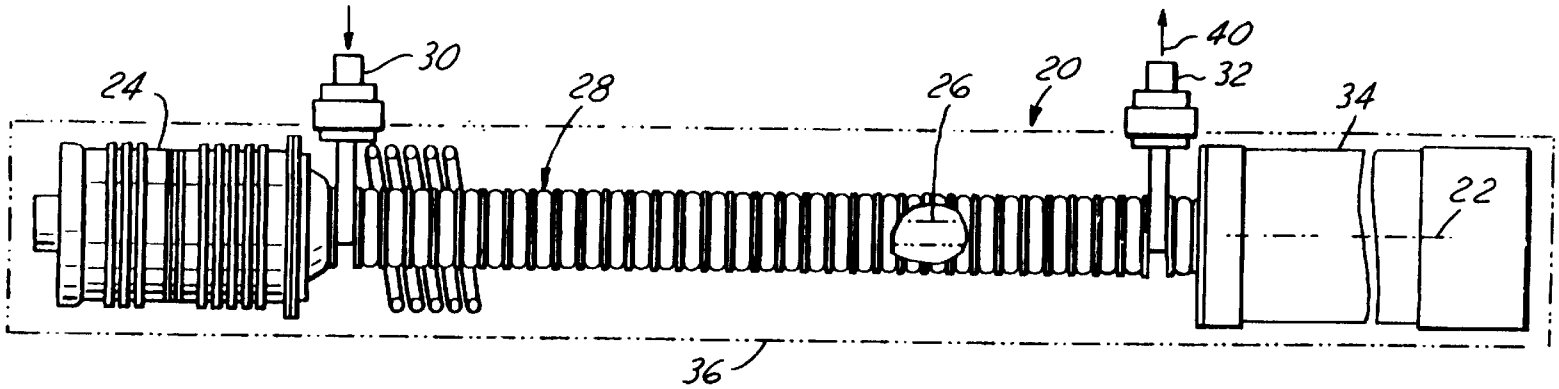
(PRIOR ART) FIG. 1
FIG. 1 is a partially cutaway side view of a conventional traveling wave tube (TWT)
Figure 2:
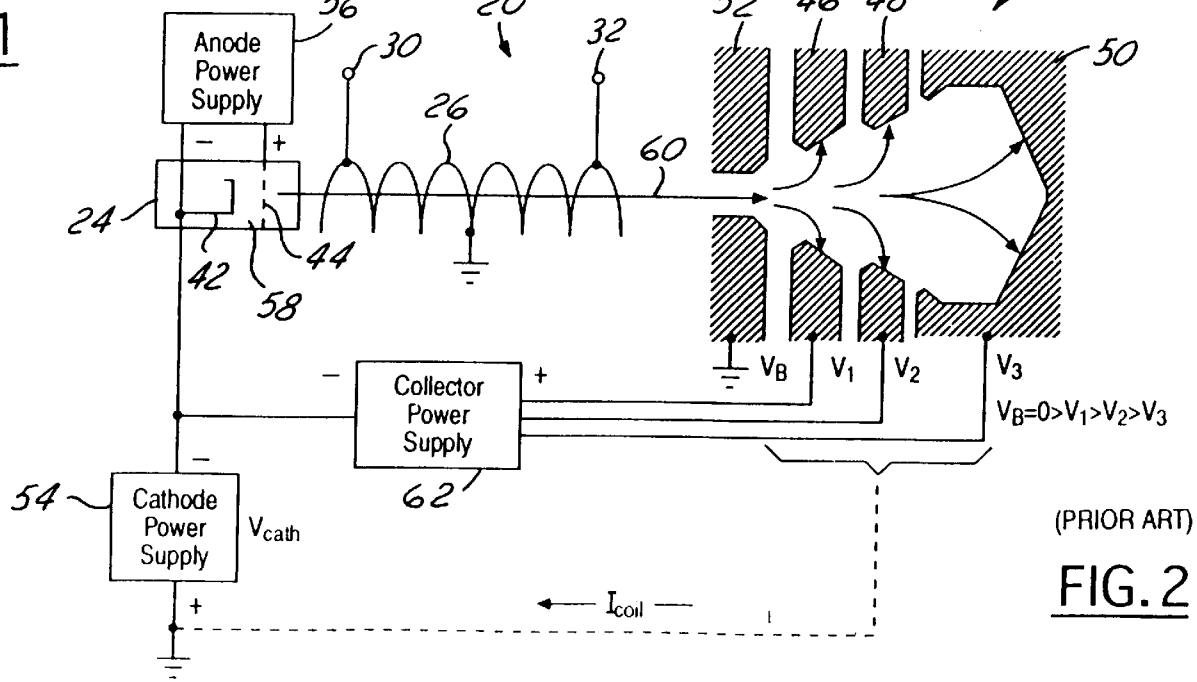
(PRIOR ART) FIG. 2
FIG. 2 is a schematic of the TWT of FIG. 1 which shows a radially sectioned, multistage collector.
Figure 3:
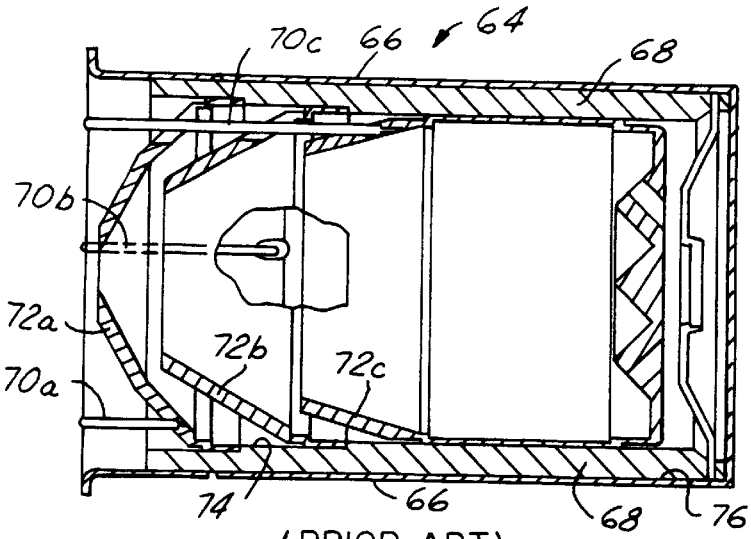
(PRIOR ART) FIG. 3
FIG. 3 is a cross-sectional view of a collector assembly of a conventional TWT.

Referring now to FIG. 3, a cross-sectional view of a collector assembly 64 of a prior art TWT is shown. Collector assembly 64 includes a sleeve 66 made of a metal or a metal/ceramic composite, a ceramic isolator or insulator 68, a plurality of electrode leads 70(*a–c*), and a plurality of collector stages 72(*a–c*). Electrode leads 70(*a–c*) are brazed to respective collector stages 72(*a–c*). Collector stages 72(*a–c*) are brazed to an inner surface 74 of isolator 68. Sleeve 66 encircles isolator 68 and is brazed to an outer surface 76 of the isolator.

Figure 4:
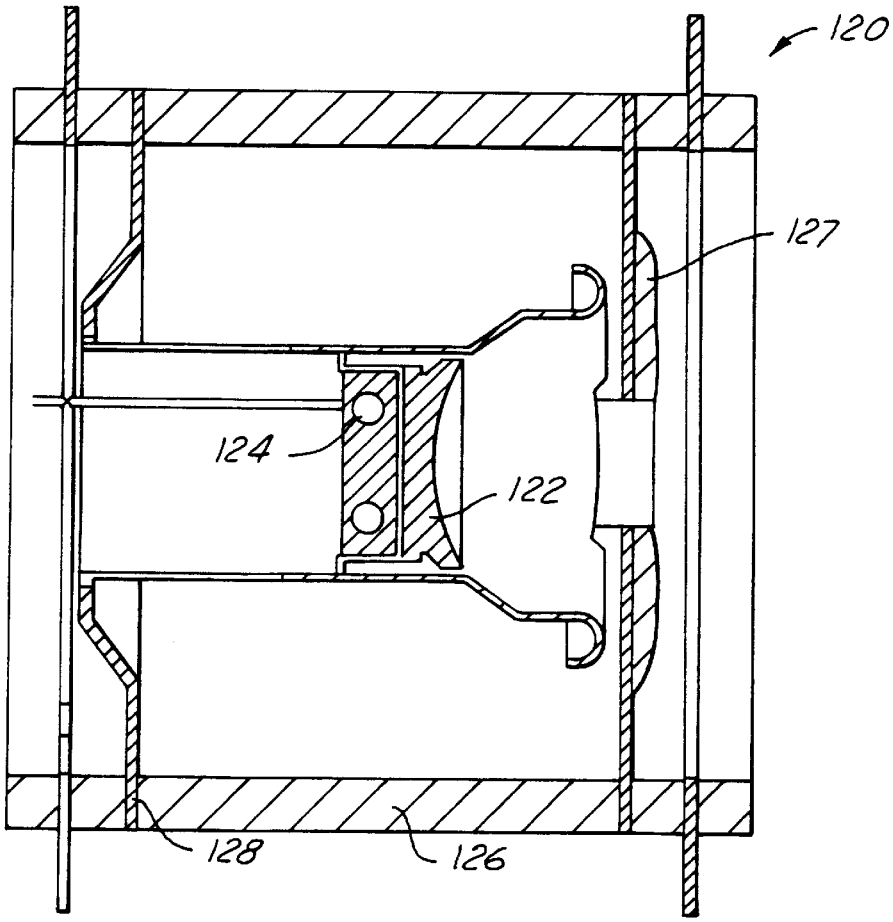
(PRIOR ART) FIG. 4
FIG. 4 is a cross-sectional view of an electron gun assembly of a conventional TWT.

Referring now to FIG. 4, a cross-sectional view of an electron gun assembly 120 of a prior art TWT is shown. Electron gun assembly 120 includes a cathode 122, a heater element 124, a ceramic isolator 126, and cathode disc 128. Cathode disc 128 is brazed or welded to cathode 122, heater element 124, and isolator 126. Electron gun assembly 120 further includes an anode 127.

Referring now to FIGS. 5 and 6, a cross-sectional view of a collector assembly 78 of a TWT according to the present invention is shown. Collector assembly 78 includes a plurality of collector stages 80(*a–b*) having collector discs 82(*a–b*). Adjacent disc-like ceramic isolators or insulators 84(*a–c*) sandwich and secure collector discs 82(*a–b*).

A stage lead connection 86 is in electrical contact with collector stage 80*a*. A spring 88 presses stage lead connection 86 against collector disc 82*a*. A stage lead connection 90 is in electrical contact with collector stage 80*b*. Collector disc 82*b* and disc-like isolator 84*c* sandwich and secure an end portion 92 of stage lead connection 90.

A sleeve 94 encircles outer surfaces 96(*a–c*) of disc-like isolators 84(*a–c*) to capture the isolators and collector discs 82(*a–b*). Sleeve 94 may be made of a metal or a metal/ceramic composite. Outer surfaces 96(*a–c*) are substantially aligned with each other. Sleeve 94 is caused to contract upon outer surfaces 96(*a–c*) of disc-like isolators 84(*a–c*) according to a heat shrinking process as shown with respect to FIG. 7 or a heat deforming process as shown with respect to FIG. 8.

Referring now to FIG. 7, a cross-sectional view of a heat shrinking assembly 98 is shown. Heat shrinking assembly 98 includes a furnace 100. Sleeve 94 is initially placed within furnace 100. Sleeve 94 initially has a radius $R_{sleeve}$ slightly smaller than the radius $R_{isolator}$ of outer surfaces 96(*a–c*) of disc-like isolators 84(*a–c*). Furnace 100 heats sleeve 94 causing the sleeve to thermally expand until the radius $R_{sleeve}$ is larger than $R_{isolator}$. Collector assembly 78 is then inserted in sleeve 94 in furnace 100. Furnace 100 is then shut off and, upon cooling, sleeve 94 contracts upon outer surfaces 96(*a–c*) of disc-like isolators 84(*a–c*).

Sleeve 94 contracts radially to capture outer surfaces 96(*a–c*) of disc-like isolators 84(*a–c*). Sleeve 94 also contracts axially to increase the pressure at the interface between collector discs 82(*a–b*) and disc-like isolators 84(*a–c*). As a result, collector discs 82(*a–b*) are securely held between disc-like isolators 84(*a–c*). End portion 92 of stage lead connection 90 is also securely held between a collector disc and a disc-like isolator as a result of the axial contraction of sleeve 94. Briefly referring to FIGS. 5 and 6, portions 97(*a–b*) of sleeve 94 extending beyond disc-like isolators 96*a* and 96*c* contract further radially inwardly to capture isolators 84(*a–c*) and enhance the pressure caused by the axial contraction.

Figure 8:
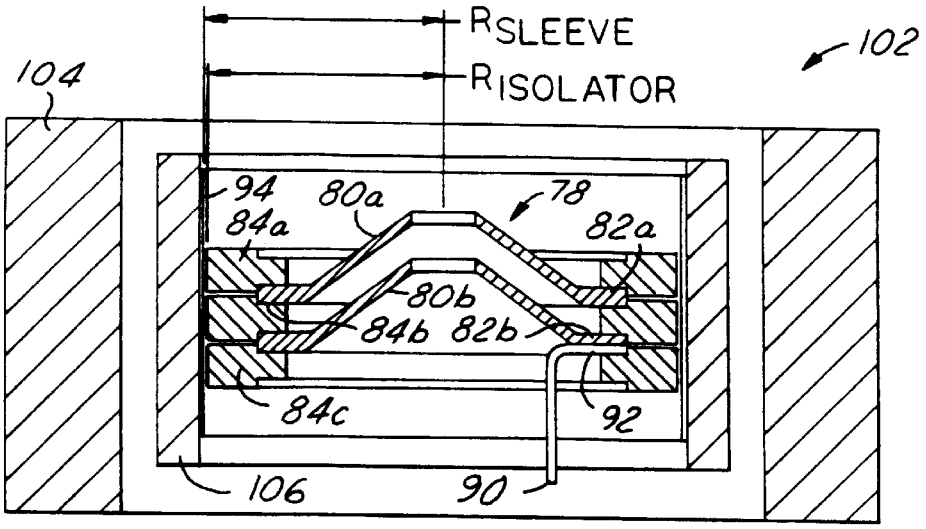
FIG. 8 illustrates a heat deformation assembly setup in accordance with the present invention.

Referring now to FIG. 8, a cross-sectional view of a heat deformation assembly 102 is shown. Heat deformation assembly 102 includes a furnace 104 and a fixture 106. In this case, sleeve 94 initially has a radius $R_{sleeve}$ slightly larger than the radius $R_{isolator}$ of outer surfaces 96(*a–c*) of disc-like isolators 84(*a–c*). Collector assembly 78 is inserted in sleeve 94. Sleeve 94 and collector assembly 78 are then placed within furnace 104 with the sleeve abutting fixture 106. Sleeve 94 has a slightly smaller radius than the radius of fixture 106 to enable the sleeve to be placed within the fixture.

Furnace 104 then heats up sleeve 94, collector assembly 78, and fixture 106. The rate of thermal expansion of fixture 106 is less than the rate of thermal expansion of sleeve 94. The rate of thermal expansion of sleeve 94 is greater than the rate of thermal expansion of isolators 84(*a–c*) . Thus, the amount of expansion of sleeve 94 is limited by fixture 106. After furnace 104 applies a sufficient amount of heat, sleeve 94 expands and interferes with fixture 106. Furnace 104 continues applying heat for a sufficient amount of time causing plastic deformation of the wall thickness and length of sleeve 94. Furnace 104 is then shut off. Upon cooling, sleeve 94 contracts upon outer surfaces 96(*a–c*) of disc-like isolators 84(*a–c*). Sleeve 94 contracts radially and axially as described above to securely hold collector discs 82(*a–b*), disc-like isolators 84(*a–c*), and stage lead connection 90.

Figure 9:
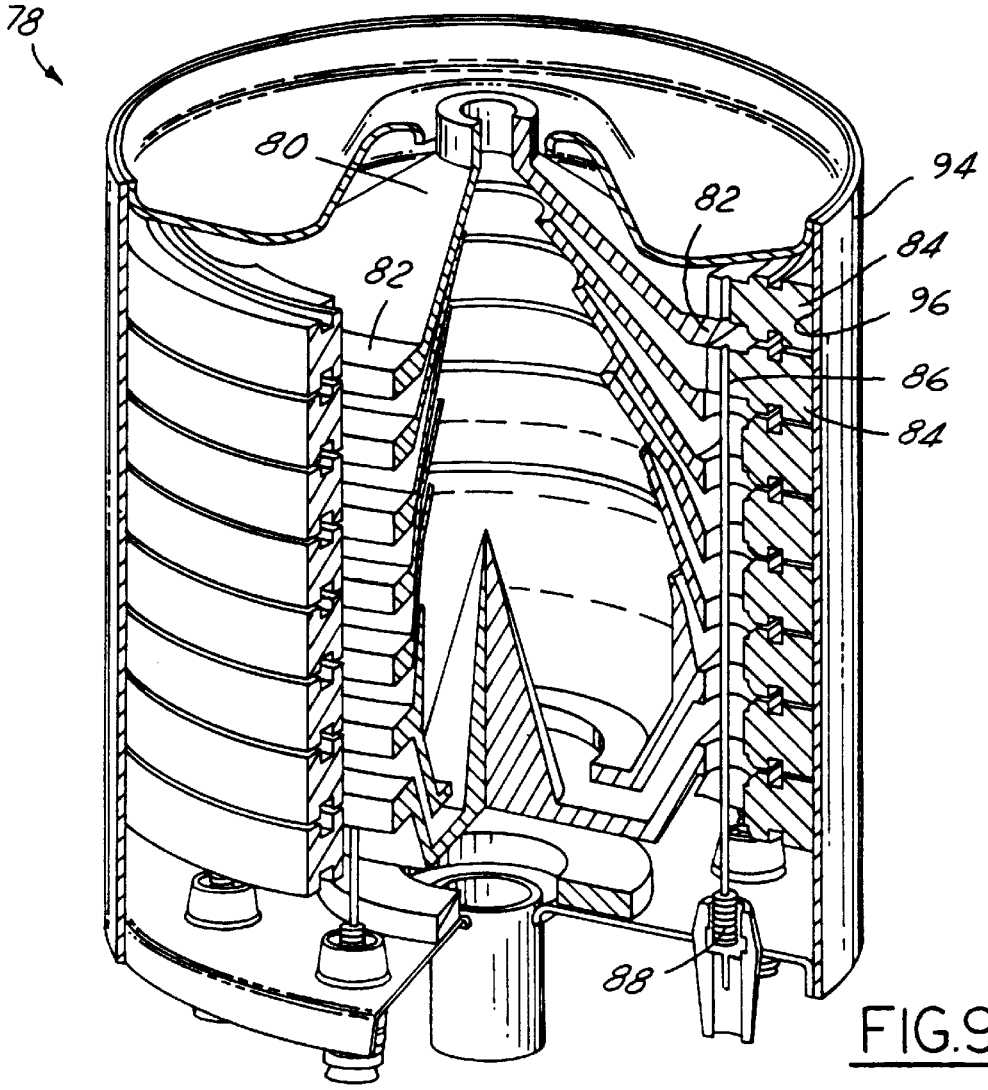
FIG. 9 is a perspective cut away view of a collector assembly according to the present invention.

Referring now to FIG. 9, a perspective cut away view of collector assembly 78 made in accordance with heat shrinking assembly 98 or heat deformation assembly 102 is shown.

Figure 10:
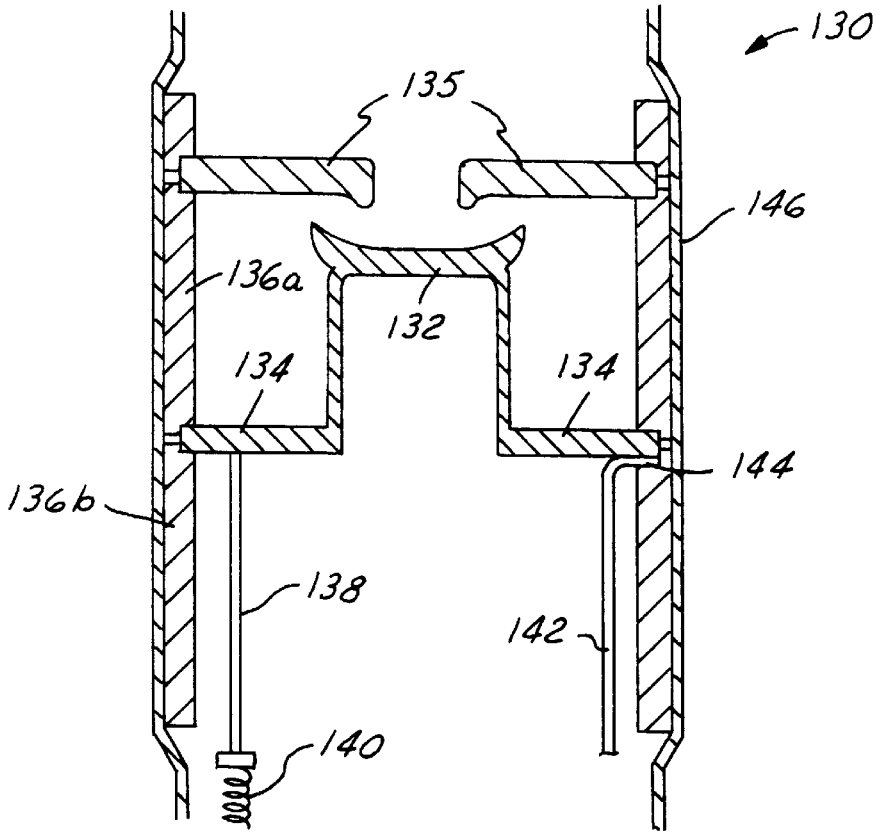
FIG. 10 is a cross-sectional view of an electron gun assembly according to the present invention.

In addition to collector assemblies, the teachings of the present invention are relevant to electron gun assemblies. Electron gun assembly 130 shown in FIG. 10 includes similar components as collector gun assembly 78. Electron gun assembly 130 has a cathode 132 provided with a cathode disc 134. Adjacent disc-like ceramic isolators or insulators 136(*a–b*) sandwich and secure cathode disc 134. Electron gun assembly 130 further has an anode 135.

A cathode lead connection 138 is in electrical contact with cathode 132 via cathode disc 134. A spring 140 presses cathode lead connection 138 against cathode disc 134. A cathode lead connection 142 having an end portion 144 is in electrical contact with cathode 132 via cathode disc 134. Cathode disc 134 and disc-like isolator 136*b* sandwich and secure end portion 144 of cathode lead connection 142.

A sleeve 146 encircles disc-like isolators 136(*a–b*) to capture the isolators and cathode disc 134. Sleeve 146 contracts radially and axially according to the heat shrinking or heat deforming processes of the present invention to securely hold cathode disc 134 and disc-like isolators 136 (*a–b*).

As shown, the present invention avoids the problems associated with welding and brazing. Thus, more robust electron gun and collector assemblies may be fabricated in a simpler procedure.

Figure 11:
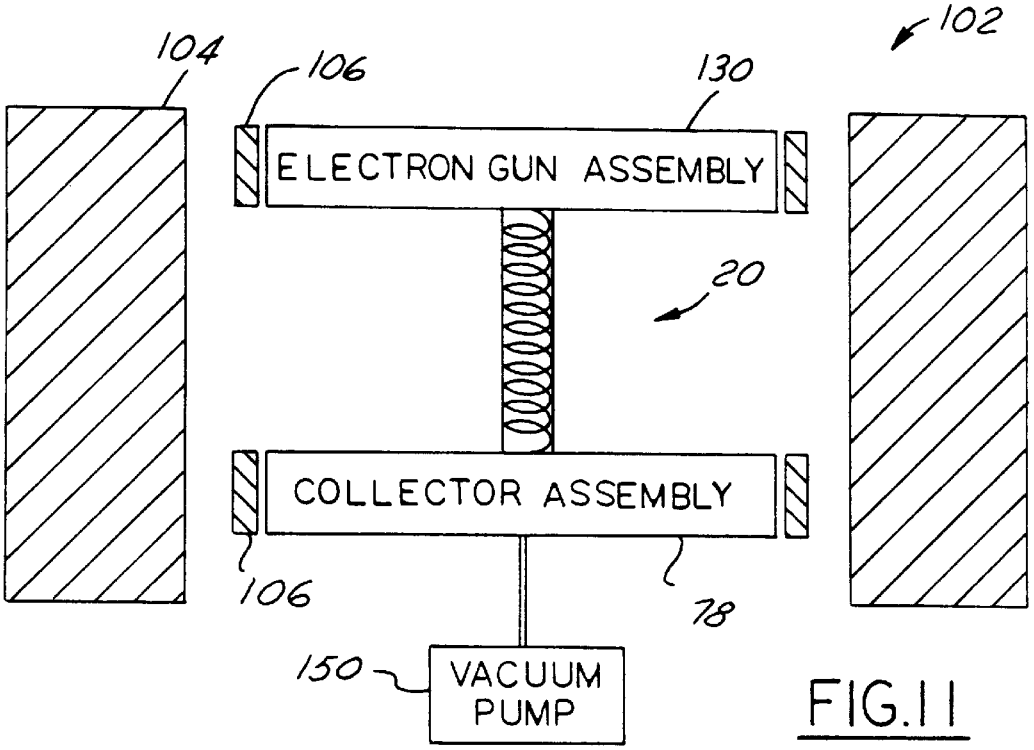
FIG. 11 illustrates a simultaneous heat deformation and high vacuum processing assembly in accordance with the present invention.

Referring now to FIG. 11, heat deformation assembly 102 may be configured to perform the heat deforming process simultaneously with a high vacuum process. The high vacuum process creates a vacuum in the electron gun and collector assemblies of a TWT. High vacuum processing (generally referred to as the bakeout or exhaust processing) includes mounting the TWT to a vacuum pump 150 and placing the TWT inside furnace 104. Vacuum pump 150 creates a vacuum in electron gun assembly 130 and collector assembly 78 of the TWT. When the vacuum pressure reaches a threshold, furnace 104 is heated to a temperature typically in the range of 300 to 550 degrees centigrade. The heat causes any volatile materials such as water inside the TWT internal vacuum region to vaporize. Vacuum pump 150 then removes the vaporized water. After a higher vacuum pressure threshold is obtained, furnace 104 is cooled and the TWT is then sealed off and separated from vacuum pump 150. Some vacuum pumps remain part of the TWT.

By properly matching the thermal expansion rates, a temperature in the typical high vacuum processing range of 300 to 550 degrees centigrade may be sufficient to deform the sleeve and capture the isolator/electrode assembly. As a result, heat deformation assembly 102 performs the heat deforming and high vacuum processes simultaneously.

It should be noted that the present invention may be used in a wide variety of different constructions encompassing many alternatives, modifications, and variations which are apparent to those with ordinary skill in the art. Accordingly, the present invention is intended to embrace all such alternatives, modifications, and variations which fall within the spirit and broad scope of the appended claims.

What is claimed is:

1. For use with a traveling wave tube provided with an electron gun assembly within a sleeve and at least one isolator therebetween, wherein the sleeve has a radius smaller than the radius of the at least one isolator, a method of mounting the parts of the assembly comprising:

heating the sleeve to cause the radius of the sleeve to increase and be larger than the radius of the at least one isolator;

placing the heated sleeve around the at least one isolator; and cooling the heated sleeve so that the heated sleeve contracts upon the at least one isolator.

2. The method of claim 1 wherein:

heating the sleeve is performed by a furnace.

3. The method of claim 1 wherein:

the at least one isolator includes a pair of disc-like isolators.

4. The method of claim 3 further comprising:

inserting an electrode disc between the pair of disc-like isolators prior to placing the sleeve around the at least one isolator.

5. For use with a traveling wave tube provided with an assembly having a sleeve and at least one isolator, wherein the sleeve has a radius larger than the radius of the at least one isolator, a method of fabricating the assembly comprising:

placing the sleeve around the at least one isolator;

heating the sleeve and the at least one isolator so that the sleeve expands to a constrained amount of expansion and then deforms; and cooling the sleeve and the isolator so that the heated sleeve contracts upon the isolator.

6. The method of claim 5 wherein:

the assembly is a collector assembly.

7. The method of claim 5 wherein:

the assembly is an electron gun assembly.

8. The method of claim 5 wherein:

heating the sleeve is performed by a furnace.

9. The method of claim 8 wherein:

the expansion of the sleeve is constrained by a fixture in the furnace, wherein the fixture has a smaller thermal expansion rate than the thermal expansion rate of the sleeve.

10. The method of claim 5 wherein:

the at least one isolator includes a pair of disc-like isolators.

11. The method of claim 10 further comprising:

inserting an electrode disc between the pair of disc-like isolators prior to placing the sleeve around the at least one isolator.

* * * * *